US005419376A

United States Patent [19]

Hawkins et al.

[11] Patent Number: 5,419,376

[45] Date of Patent: May 30, 1995

[54] WOVEN GROMMET STRUCTURE FOR CANVAS-LIKE MATERIALS

[75] Inventors: Kevin Hawkins, Williamsport, Pa.; John Zimmerle, Tabernacle; John A. Mortensen, Little Silver, both of N.J.

[73] Assignee: C. M. Offray & Son, Inc., Chester, N.J.

[21] Appl. No.: 225,786

[22] Filed: Apr. 11, 1994

[51] Int. Cl.[6] ..... D03D 1/00; D03D 3/00

[52] U.S. Cl. ..... 139/384 R; 24/659; 2/266; 139/22

[58] Field of Search ..... 139/383 R, 384 R, 22; 2/266; 24/659

[56] References Cited

U.S. PATENT DOCUMENTS

| | | | |
|---|---|---|---|
| 830,034 | 9/1906 | Ziegler | 139/384 R |
| 1,027,690 | 5/1912 | Clauss | 139/384 R |
| 1,977,137 | 10/1934 | Moore | 139/384 R |
| 1,998,041 | 4/1935 | Barbet | 139/384 R |
| 2,021,993 | 11/1935 | Gutlon | 139/384 R X |
| 2,301,261 | 11/1942 | Diehl et al. | 139/384 R |

*Primary Examiner*—Andrew M. Falik

*Attorney, Agent, or Firm*—Mark T. Basseches; Paula T. Basseches

[57] ABSTRACT

A fabric anchor device for attachment to awnings or the like for holding awning retaining ropes. The device comprises a woven fabric strip having a central reinforcing spine defined by paired high tensile strength reinforcement warp yarns. The spine includes a series of mutually spaced apart attachment apertures, the respective reinforcement yarns lying on opposite sides of the apertures.

4 Claims, 1 Drawing Sheet

WOVEN GROMMET STRUCTURE FOR CANVAS-LIKE MATERIALS

BACKGROUND OF THE INVENTION

The present invention is directed to a device, namely a fabric for attachment to awnings, tarpaulins or the like, the fabric including longitudinally spaced anchor apertures. The fabric is intended as a substitute for grommets conventionally employed as the means for receiving tie-down ropes.

PRIOR ART

In the fabrication of awnings, tarpaulins, sails and like applications, it is conventional practice to apply spaced grommets adjacent the fabric edges of the canvas or like material forming the awning. The grommets are typically comprised of complementally shaped metal components which are applied by piercing the cloth of the awning, passing one grommet component through the pierced aperture, and crimping the projecting portions of the grommet component to a complementally sized component at the opposite side of the fabric.

It is known in addition, to apply the spaced grommets to a narrow fabric strip which is subsequently attached, as by sewing, to the major body of the awning fabric. It is to be understood that the term awning, as used herein, is to be recognized as representative of the various applications, such as tarpaulins and the like to which the device of the instant invention is applicable.

Conventional grommeting as described above is a tedious procedure requiring the service, of skilled artisans. Grommeting is disadvantageous in that in addition to the metal of the grommets degrading over time, the strength of the connection between grommet and fabric is dependent upon strength of the fabric at the limited point of attachment of grommet and fabric. The grommet functions as an anchor point for a rope, and thus when the awning fabric is subjected to stresses such as wind induced stresses, the forces are applied to the grommet and in turn to the fabric at a specific limited area. In applying a grommet to awning fabric (or to a discrete strip to be attached to the fabric) the fabric is pierced in a somewhat random fashion, the ability of a given grommet to withstand stresses being depended upon the tear strength resistance of the fabric at the anchor point of each respective grommet.

It is, of course, possible simply to form spaced apertures equivalent to button holes directly in an awning fabric or in a strip to be applied to an awning fabric. However, no satisfactory mode of forming anchor points having high stress resistance in fabric has heretofore been known.

In the course of a prior art search the below noted patents have been located. The patents are directed to button hole and/or button hole forming devices. None of the cited references is considered to teach or suggest the invention hereof. The located patents are as follows:

1,181,769
1,187,075
1,991,972
2,342,569
2,518,949
2,781,013
3,701,167
3,793,647
3,845,732

In essence, while the noted references teach various means for forming button holes, none of the suggested aperture defining concepts is suitable for providing an anchor point susceptible of resisting significant shear forces.

More particularly, and in general, the references form the eyelet or button hole by piercing an increment of fabric and surrounding the resultant aperture with stitching to prevent unraveling of the fabric surrounding the puncture. In all instances, the ability of the button hole to resist tearing forces is a function strictly of the tear strength of the respective fabric within which the button hole is formed.

SUMMARY OF THE INVENTION

The invention may be summarized as directed to a fabric for use as an anchor device for attachment to awnings, tarpaulins or the like, the fabric being a woven fabric and having formed therein a spaced series of attachment apertures for the reception of retaining ropes or the like. The fabric of the invention is preferably in the form of a narrow strip adapted to be sewn to the margins of the fabric defining the major body of the awning.

A characterizing feature of the fabric resides in the incorporation therein of a longitudinally extending reinforcing spine, the attachment apertures being defined by reinforcing warp yarns formed within the spine.

More particularly, the fabric strip includes at least two centrally disposed high strength warp yarns (or bundles of yarns) defining a high tensile strength spine. A first series of weft yarns extend from a first side edge to the spine and second series of weft yarns extend from the opposite side edge to the spine. The first and second series of weft yarns include inner loop extremities encompassing both of the first and second reinforcing warp yarns, and outer loop extremities at the respective sides of the fabric. The first and second series of weft yarns encompass both of the reinforcing warp yarns to define the spine except at intervening areas within the spine which define attachment apertures. At the attachment aperture areas, the weft yarns of the first and second series encompass a respective one only of the reinforcing warp yarns, whereby a space is defined between the reinforcing warp yarns and between the weft yarns of the first and second series, the space providing an anchor point or aperture which is a substitute for conventional grommeting.

The reinforcing warp yarns which define the spine are preferably formed of a filament of relatively low coefficient of friction yarn material, whereas the weft yarns are preferably formed of spun relatively higher coefficient of friction materials.

Tests of the anchor fabric in accordance with the invention have demonstrated the ability of apertures of comparable size to the apertures of grommets to resist two to three times the forces which may be resisted by a conventional grommet construction. The central spine defined by the reinforcing warp yarns provides a fabric which is highly resistant to longitudinal elongation and thus, when attached to a margin of an awning or the like, provides a substantial reinforcement of the awning fabric.

In accordance with a preferred embodiment of the invention the attachment apertures are formed such that the reinforcing yarns criss-cross at the extremities of the attachment apertures. Further, preferably, the reinforcing warp yarns exiting from the attachment apertures are encompassed by two loop extremities of weft yarns only from the opposite Series of weft yarns from the series encompassing the reinforcing yarns in the area of the attachment aperture. By this construction, when severe stresses are applied at the attachment aperture, the combination of the relatively slippery reinforcing warp yarns and high friction weft yarns tends to result in a bunching of the weft yarns, which is believed to materially increase the resistance of the attachment aperture to tearing by distributing stress among a group of the weft yarns surrounding the aperture. It has been observed that even if one or more of the weft yarns immediately at the extremities of the attachment aperture are ruptured, the bunching action precludes the continued spread of the rupture by in essence grouping or combining the adjacent bunched weft yarns into a integral group having a strength which is a multiple of the strengths of the individual yarns.

It is accordingly an object of the invention to provide an anchor device in the form of a woven fabric strip having a central reinforcing spine, the spine being provided with longitudinally spaced apart apertures adapted to receive the retaining ropes for maintaining the awning, tarpaulin or the like device in a desired position.

A further object of the invention is the provision of a device of the type described wherein the apertures are highly resistant to tearing.

A still further object of the invention is the provision of a reinforcing woven fabric device for attachment to the margins of awnings, which is durable, weather resistant, and substantially less expensive to fabricate than conventional grommeting.

DETAILED DESCRIPTION OF DRAWINGS

Figure 1:
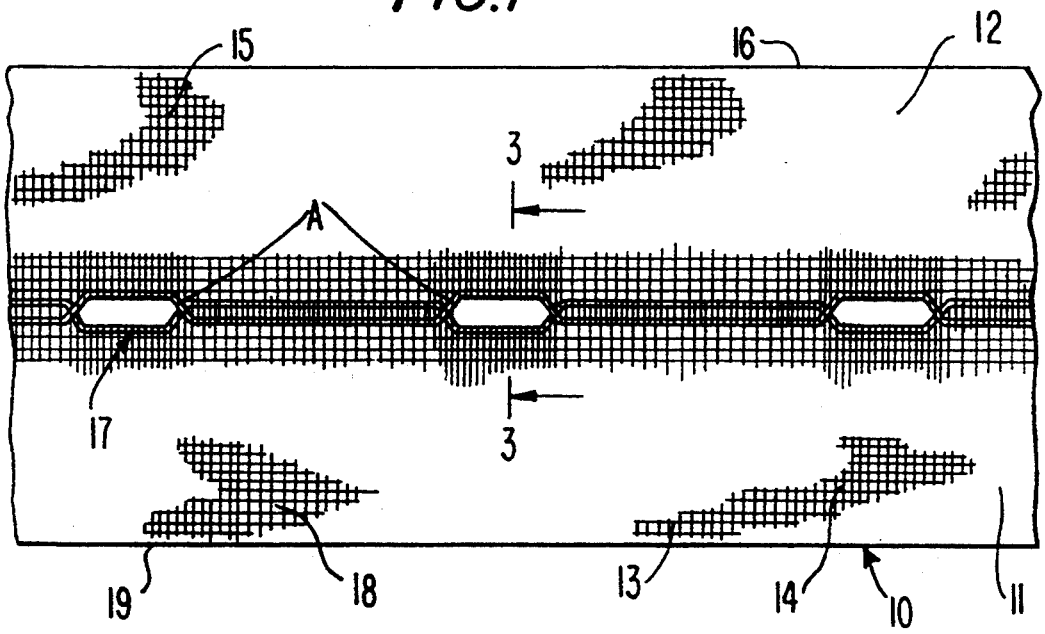
FIG. 1 is a plan view of a length of fabric in accordance with the invention.

Referring to FIG. 1 there is disclosed a length of a fabric anchor device 10 comprised of an integrally woven fabric including a lower fabric half 11 and an upper fabric half 12. The lower and upper fabric halves are comprised of conventional warp yarns 13 and weft yarns 14. The device comprises essentially two separate double layer fabric components in which warp yarns 13 are woven with a first or upper series of weft yarns 15 extending from upper edge 16 of the fabric to central spine 17 and a second series of weft yarns 18 extending from edge 19 to the spine 17.

The inner extremity of the weft yarns of the first and second series (15 and 18 respectively) encompass spine 17 which is comprised of a pair of reinforcing warp yarns 20, 21. While yarns 20 and 21 have, for ease of understanding, been shown as single filaments in the instant drawings, it will be appreciated that each of such yarns may be comprised of two or more filaments. A preferred thread or yarn for use as reinforcing yarns 20, 21 is sold by Allied Signal Inc. of Morristown, N.J. under its trademark SPECTRA, the yarn comprising a polyethylene homopolymer. These yarns are of relatively slippery nature, have a very high tensile strength, and preferably are of a diameter of at least about two to three times the diameter of the warp yarns 13 defining the major fabric body.

The yarns defining the weft series 15 and 18 are preferably formed of spun acrylic yarns having a higher coefficient of friction than the yarns 20 and 21 tending to reduce the tendency of slippage between the weft yarns and the reinforcing warp yarns 20, 21 which would occur if both warp and weft yarns were filaments.

Figure 2:
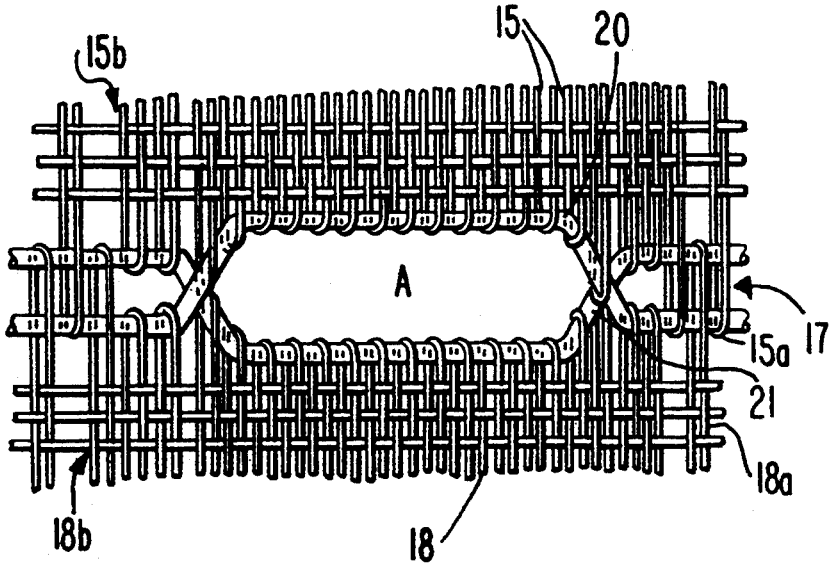
FIG. 2 is an enlarged schematic view showing a detail of the fabric structure immediately surrounding an anchor aperture.
Figure 3:
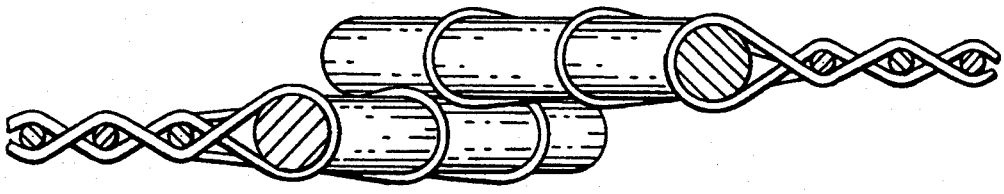
FIG. 3 shows schematically a magnified section taken on the line 3—3 of FIG. 1.

Referring now particularly to FIG. 2, there is disclosed in schematic fashion the pattern of yarns defining the spine 17 and the attachment apertures A of the anchor fabric. As best seen in FIG. 2, the major body of the spine 17 is formed by encompassing both of the reinforcing yarns 21 and 20 between alternate loops **15*a*,18*a* of the respective series of weft yarns 15,18. Thus, the spine 17 is comprised of a series of reinforcement areas wherein the yarns 20, 21** are maintained in intimate engagement by the alternating weft yarns of the respective series.

The reinforcement areas of the spine 17 are interrupted by a series of spaced attachment apertures A. As best seen in FIG. 2 in attachment area A reinforcing yarn 20 is encompassed solely within weft yarns of the series 15, whereas reinforcing yarn 21 is encompassed solely within weft yarns of the series 18. Preferably, reinforcing yarns emerging from the aperture areas A are encompassed within two loops of weft yarns of the opposite series from the yarns which encompassed such reinforcing yarn in the area of the aperture.

By way of example, yarn 21 which is encompassed by weft yarns of series 18, upon emerging from the attachment aperture area is encompassed by two yarns **15*b* of series 15 in advance of the spine defining reinforcement area wherein alternate picks of weft series 15 and 18 encompass both reinforcement warp yarns. In similar fashion, reinforcing warp yarn 20 at the exit of aperture A is first encompassed within two loops of weft yarns 18*b* from the series of weft yarns 18**. The structure at the limits of the attachment apertures is preferred and is described in keeping with the best mode requirements of the patent laws, it being recognized that modification of the specific fabric patterning at the extremities of the attachment apertures made be made.

MANUFACTURING DETAILS

Without limitation, and in compliance with the best mode requirements of the patent laws, there is described below a representative example of an anchor fabric in accordance with the invention. As a representative example, the width is 2 inches, with the spine being spaced at least ½ inch from one edge, the warp yarns 13 are made of spun acrylic and the weft yarns 14 of spun nylon. The reinforcing warp yarns 20, 21 are made of high tenacity Spectra yarn manufactured by Allied Signal Inc. The weave pattern is 77 warp yarns and 32 weft yarns to the inch. In the representative example, the attachment apertures A are spaced apart by 2 inches on center. The length of each of the attachment apertures is approximately ½ inch.

Details of the manufacturing apparatus and method are as follows. The fabric woven using a needle loom machine made by Jacob Muller with Zett double needle attachment.

The fabric as described was tested for tear strength of the apertures. The test procedure was as follows:

A length of fabric 2 inches in width and having its spine spaced ½ inch from one edge was clamped between the stationary jaws of a Scott tester clamp. The clamp was applied approximately ¾ inch from the fabric edge furthest from the spine. The clamp width was 3 inches. A length of number four Boyle rope (8 inches appr) was threaded through an aperture in the spine, the ends of the rope being clamped at a spacing of 2¾ inches between the jaws of a movable Scott tester clamp.

The movable clamp was shifted away from the fixed clamp along an axis perpendicular to the spine to thereby tension the rope and aperture. The force applied by the movable clamp was increased progressively reaching 120 pounds without damage.

At 125 pounds rupture of one or more of the load bearing yarns was observed, but the integrity of the aperture was maintained. Significant tearing of the fabric surrounding the apertures was not observed until a force of 200 pounds was applied. The stress resistance of the fabric aperture is totally acceptable in awnings and like installations which typically employ conventional grommeting and far exceeds the stress resistance of grommeted fabrics of comparable weight.

As will be apparent from the foregoing, there is illustrated and described a unique anchor device, namely a woven fabric strip having a central reinforcing spine defined by high tensile warp yarns, such yarns being maintained in intimate juxtaposition in the areas between apertures (reinforcing areas) and being spaced to opposite sides of the intervening attachment apertures. The strip is readily manufactured and when appropriately attached to the margins of an awning provides a weather resistant and extremely durable anchor arrangement for awning ropes being far more resistant to tearing than conventional grommeting arrangements.

In addition to the mechanical advantages provided by the device there is eliminated the unsightly and readily corroded grommeting, together with the attendant expense of fabricating same.

While the invention has been described in connection with a specific embodiment, it should be readily recognized that numerous variations in details of structure will occur to those skilled in the art and familiarized with the instant disclosure.

Accordingly, the invention is to be broadly construed within the scope of the appended claims.

Having thus described the invention and illustrated its use, what is claimed as new and is desired to be secured by Letters Patent is:

1. A fabric anchor device for attachment to awnings, tarpaulins and the like for use as a substitute for grommets comprising a narrow elongate woven fabric strip including a body portion having first and second side edges and a longitudinally extending spine intervening between said edges, said spine including reinforcement areas having longitudinally spaced apart attachment apertures formed therein, said spine comprised of a first and a second high tensile strength reinforcement warp yarn, a first series of weft yarns extending from said first side edge to said spine, a second series of weft yarns extending from said second side edge to said spine, said first and second series of weft yarns having inner loop extremities encompassing both of said first and second reinforcing yarns in said reinforcement areas, loops of said weft yarns of said first and second series each encompassing a respective one only of said reinforcements yarns at the areas of said attachment apertures, said reinforcing yarns criss crossing adjacent the extremities of said attachment apertures whereby said reinforcing yarns are maintained in juxtaposition by said weft yarns at said reinforcing areas and in spaced relation at the areas of said attachment apertures.

2. An anchor device in accordance with claim 1 wherein said weft yarns have a higher coefficient of friction than said reinforcement warp yarns.

3. An anchor device in accordance with claim 2 wherein said reinforcement warp yarns comprise one or more filaments and said weft yarns comprise spun yarns.

4. An anchor device in accordance with claim 1 wherein said reinforcement yarns exiting from said attachment apertures are encompassed by two loop extremities of weft yarns only from the opposite series of weft yarns from the series encompassing said yarns at said attachment aperture.

* * * * *